United States Patent [19]

Lynds

[11] Patent Number: 4,945,985

[45] Date of Patent: Aug. 7, 1990

[54] PIPE DOWN-HOLE RETRIEVAL TOOL

[76] Inventor: Robert L. Lynds, 1043 Old Hiway 12 Mile Rd., Addy, Wash. 99101

[21] Appl. No.: 446,478

[22] Filed: Dec. 5, 1989

[51] Int. Cl.[5] ..... E21B 31/18

[52] U.S. Cl. ..... 166/98; 166/301; 294/86.33

[58] Field of Search ..... 166/301, 99, 98, 385; 294/86.1, 86.16, 86.33

[56] References Cited

U.S. PATENT DOCUMENTS

| | | | |
|---|---|---|---|
| 49,628 | 8/1865 | Hinsdale | 294/90 X |
| 776,749 | 12/1904 | Mann | 294/86.33 X |
| 1,027,423 | 5/1912 | Krauskopf | 294/86.33 |
| 1,186,351 | 6/1916 | Wallace | 294/86.33 X |
| 1,317,229 | 9/1919 | Shinskie | 294/86.33 |
| 1,512,411 | 10/1924 | Farrier | 294/86.33 X |
| 1,634,935 | 7/1927 | Donnelly | 294/86.33 |

*Primary Examiner*—Stephen J. Novosad

*Attorney, Agent, or Firm*—Wells, St. John & Roberts

[57] ABSTRACT

A pipe and pump retrieval tool 10 is described for removing a disconnected or "lost" pipe and pump assembly 20 from the bottom 16 of a well 12. The retrieval tool 10 includes elongated body 40 illustrated in FIGS. 2, 6 and 8 extending from a lower end 42 to an upper end 44. A shoulder engaging means 50 is associated with the upper end for receiving and engaging a pipe section and a pipe coupling 28. A retrieval cable 60 connects to the lower end 44 and is threaded through a cable stabilizing means 64 to naturally orient the elongated body 40 at an incline angle with the upper end 44 and lower end 42 sliding along opposite sides of the interior of the well wall 14. A safety cable connecting means 68 is provided to enable the retrieval tool 10 to be removed from the well and disconnected from the pipe and pump assembly 20 should the assembly 20 be stuck at the bottom of the well.

11 Claims, 3 Drawing Sheets

PIPE DOWN-HOLE RETRIEVAL TOOL

TECHNICAL FIELD

This invention relates to tools for retrieving disconnected down-hole pipe and pumps from wells.

BACKGROUND OF THE INVENTION

It is not uncommon for a down-hole pump and pipe section to become disassociated with the remainder string of the pipe extending from the bottom of the well to the surface. When such an unfortunate situation arises, it is necessary to "fish" the pump and pipe assembly from the bottom of the well so that the pipe sections can be properly reconnected.

Because of the importance of retrieving the pump and pipe assembly, various tools and techniques have been attempted with varying degrees of success to retrieve the "lost" pump and pipe assembly.

The purpose of this invention is to provide an inexpensive yet very effective tool for retrieving the disconnected down-hole pump and pipe assembly in a rather rapid fashion.

A further advantage of this invention is the provision of means for retrieving the tool should the pump and pipe assembly be stuck at the bottom of the well.

These and other objects and advantages of this invention will become apparent upon reading the description of the preferred embodiment.

BRIEF DESCRIPTION OF THE DRAWINGS

The preferred embodiment of the invention is illustrated in the accompanying drawings, in which.

DETAILED DESCRIPTION OF THE PREFERRED EMBODIMENT

The following disclosure of the invention is submitted in compliance with the constitutional purpose of the Patent Laws "to promote the progress of science and useful arts" (Article 1, Section 8).

Figure 1:
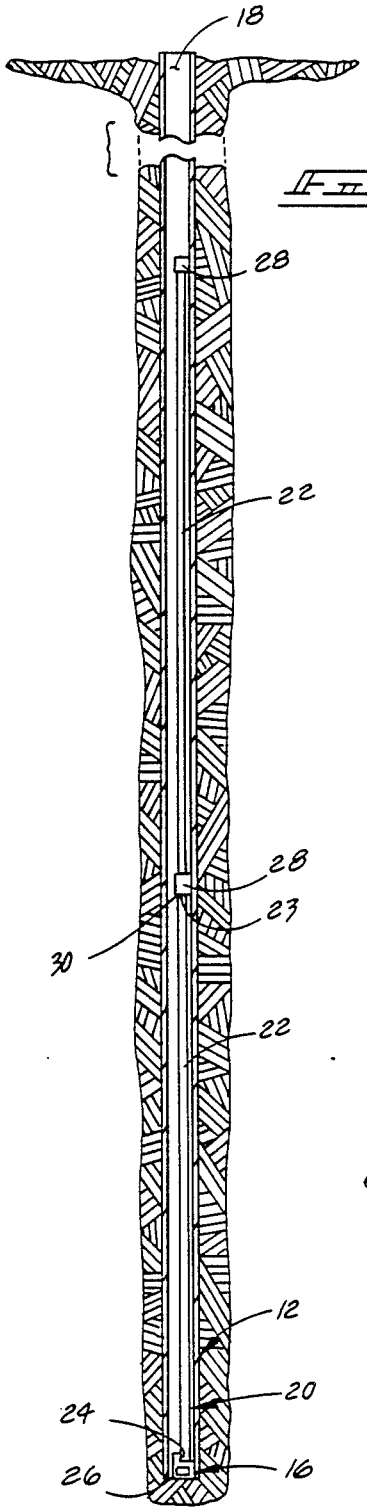
FIG. 1 is a vertical cross-sectional view of a well illustrating an unconnected pipe and pump assembly at a bottom of the well.
Figure 2:
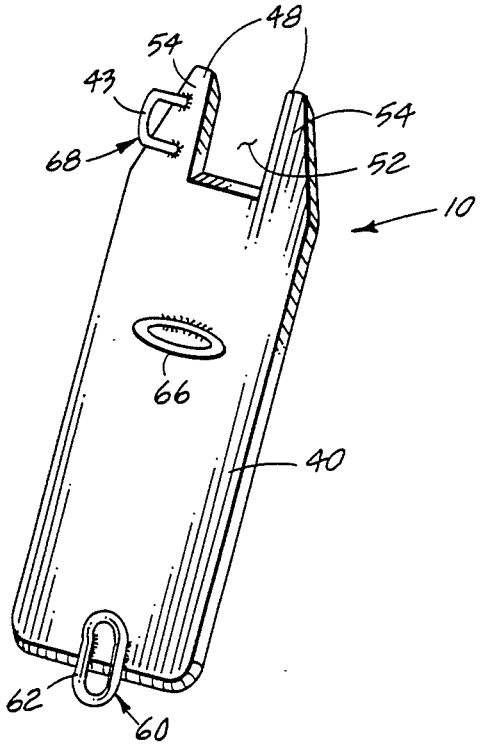
FIG. 2 is an isometric view of a preferred embodiment of the subject invention for retrieving the pump and pump assembly from the bottom of the well.

Referring to the drawings, there is illustrated in FIG. 2, a down-hole pipe retrieval tool generally designated with the numeral 10 for retrieving a "lost" or disconnected pipe and pump assembly 20 from the bottom 16 of a well 12.

The pipe and pump assembly 20 includes two or more pipe sections 22 each pipe section having a lower end 23. The lower most pipe section 22 has its lower end 24 connected to the pump 26. Each of the pipe sections 22 are connected by a pipe coupling 28. The tool 10 is principally designed for fitting into four inch, six inch or twelve inch well wall or casings 14. The size of the retrieval tool 10 will be varied in accordance with the inside diameter of the well casing 14. The pipe sections 22 can be made of rigid plastic or steel and have exterior diameters of one inch, one and a quarter inch, one and a half inch or two inches depending upon the size of the pump and the size of the well 12.

The pipe coupling 28 has an exterior diameter that is greater than the exterior diameter of the pipe section 22 forming a joint shoulder 30 adjacent the upper end 23 of each pipe section 22. The purpose of the retrieval tool 10 is to be easily lowered down the well 12 to a location alongside pipe sections 22 below at least one of the pipe couplings 28. The retrieval tool 10 when pulled upwardly engages the joint shoulder 30 of the pipe coupling 28 to grip the pipe and pump assembly 20 to raise the assembly upward in the well as retrieval tool 10 is pulled to the top opening 18.

The retrieval tool 10 includes an elongated body 40 in which the length and width are dependent upon the internal diameter of the well casing 14. Preferably the elongated body has a length that is greater than twice the internal diameter of the casing 14 and a width that is less than the diameter of the casing 14 but greater than the exterior diameter of the pipe section 22. The elongated body has a center of gravity identified with the numeral 41 that is intermediate a lower end 42 and an upper end 44. The upper end 44 has opposite side surfaces 46 that are beveled forward and inwards towards the extremity of the upper end 44 to form a nose 48. The surfaces of the nose 48 are complementary to the contour of the inside wall surface of the casing 14 to enable the upper end 44 to readily slide downward as the retrieval tool is lowered in the well 12.

The elongated body has a shoulder engaging means 50 at the upper end 44 for engaging the joint shoulder 30 to grip the pipe and pump assembly 20 to cause the pipe and pump assembly 20 to be raised from the bottom 16 of the well 12 as retrieval tool 10 is pulled upward in the well 12. In the preferred embodiment, the shoulder engaging means 50 is formed integrally with the upper end 44 and includes a notch or mouth 52 formed in the nose 48. The notch or mouth 52 has a width slightly greater than the diameter of the pipe section 22 and the exterior diameter of the pipe coupling 28. The pipe coupling is received with the notch 52 with sides 54 extending alongside the pipe coupling 28, circumscribing the pipe section 22 to facilitate the engagement of the shoulder joint 30 as the retrieval tool 10 is pulled upward. The shoulder engaging means 50 includes beveled surface 56 formed at the base of the notch 52 forming a rather sharp edge to more firmly grip and engage the joint shoulder 30 to prevent disengagement during the ascent.

Retrieval tool 10 further includes a retrieval cable connecting means generally designated with the numeral 60 for connecting to the lower end of a retrieval cable 61 that is utilized for raising and lowering the retrieval tool 10. In a preferred embodiment the retrieval cable connecting means includes a double ring 62 affixed to the lower end 42 of the elongated body 40. The double ring 62 has ring sections 62A and 62B. The ring portion 62A is designed to receive the lower end of the retrieval cable 61. The ring portion 62B is designed to enable an additional weight to be attached or connected to the elongaed body 40 if need be to lower the retrieval tool into a very deep well. If the well is quite deep, the frictional forces of the retrieval cable 61 with the casing 14 may minimize the ability of the retrieval tool to fully descend to the bottom 16. For a very deep well, it may be necessary or helpful to connect a weight to the elongated body 40 utilizing an attachment cable to the ring section 62B. Such a feature is not illustrated in the drawings.

Figure 3:
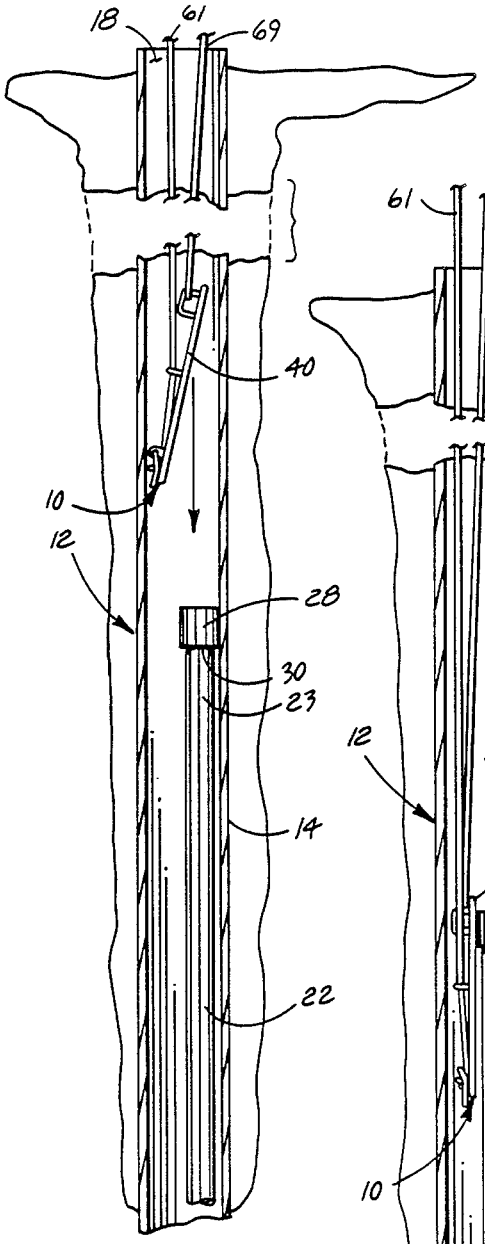
FIG. 3 is a vertical cross-sectional view of the well as illustrated in FIG. 1, except showing the initial lowering of the preferred embodiment in the well.
Figure 4:
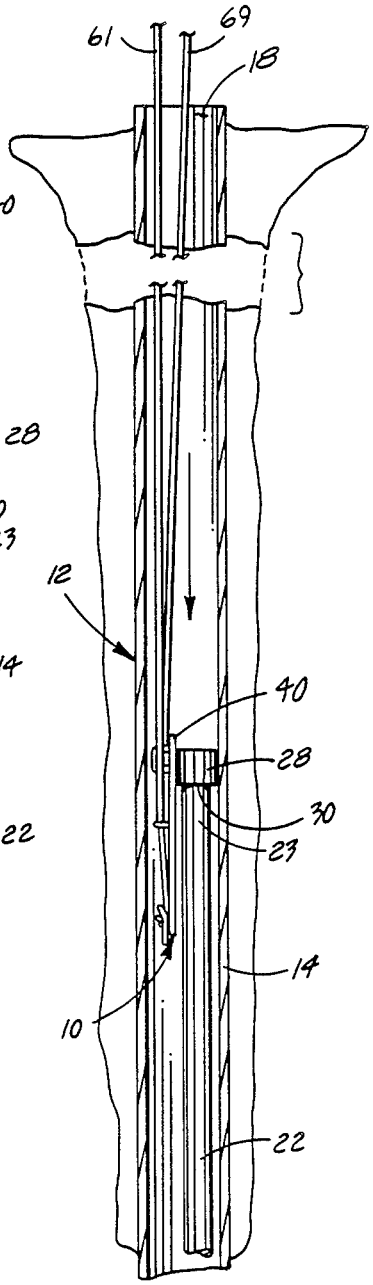
FIG. 4 is a vertical cross-sectional view of the well illustrated in FIG. 3, except showing the lowering of the retrieval tool to a location along side the pipe section and below a pipe coupling.
Figure 5:
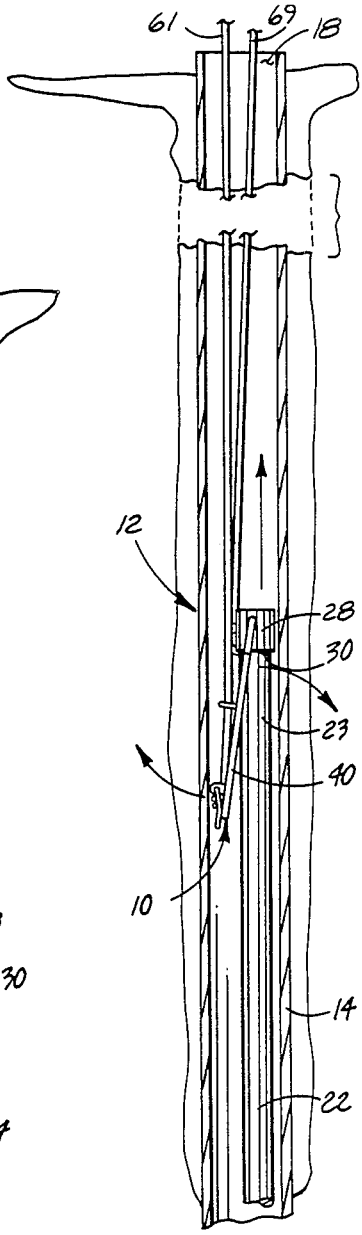
FIG. 5 is a vertical cross-sectional view similar to FIG. 4 except showing the retrieval tool being pulled upward along with the pipe and pump assembly.
Figures 6, 7, 8:
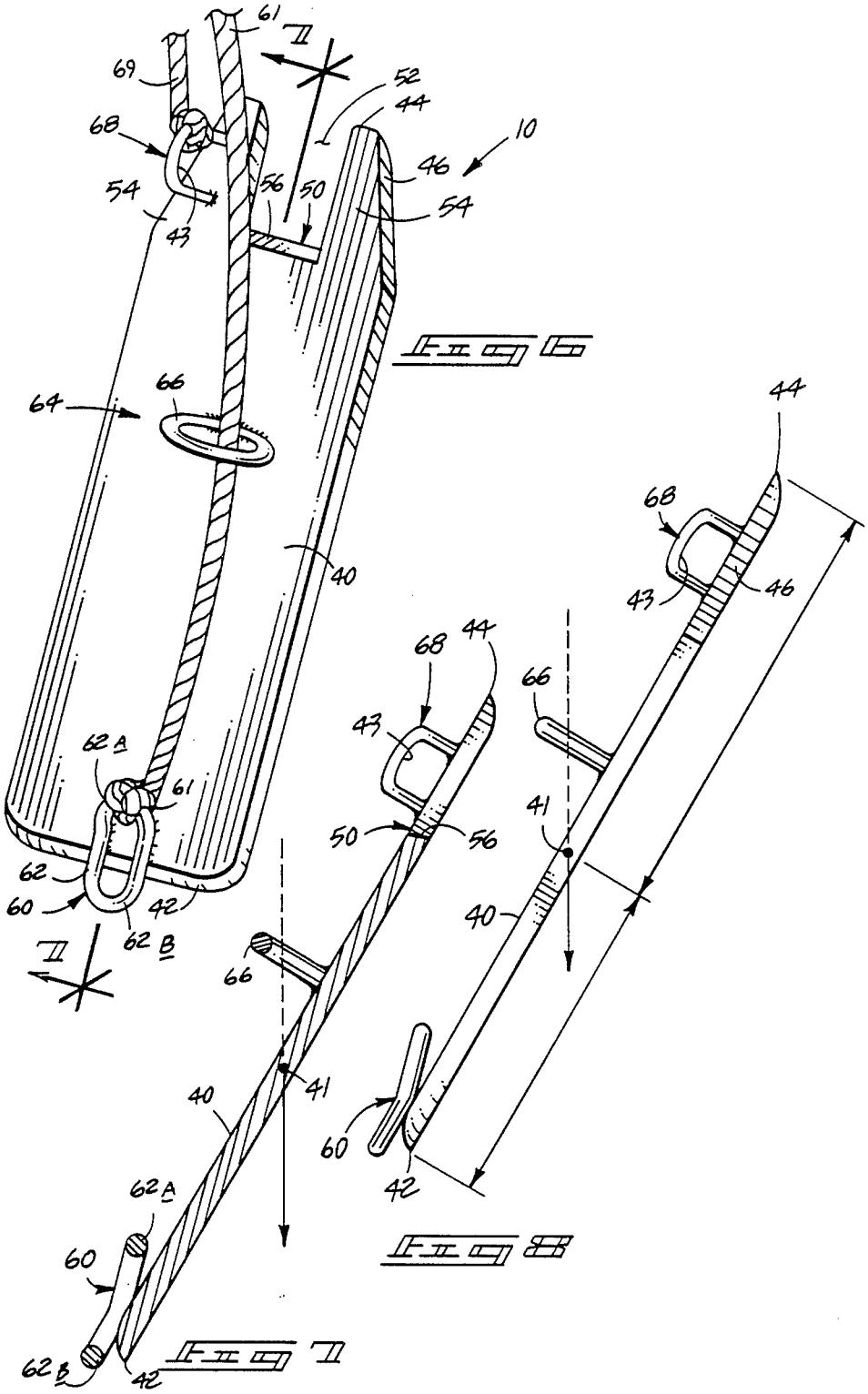
FIG. 6 is an isometric view of the preferred embodiment showing a retrieval cable and a safety cable connected to the retrieval tool.
FIG. 7 is a cross-sectional view taken along line 7—7 in FIG. 6.
FIG. 8 is a side elevation view of the preferred embodiment illustrating the center of gravity and the natural angle of inclination.

Further, the retrieval tool includes a cable stabilizing means 64 for stabilizing the descent and ascent of the elongated body 40 to minimize the possibility of the elongated body from becoming stuck within the wall casing during the descent and for further guiding the elongated body to facilitate its engagement in gripping of the pipe and pump assembly 20. The cable stabilizing means 64 is operatively connected to the retrieval cable 61 and to the elongated body at a location spaced from the center of gravity 41, between the center of gravity 41 and the upper end 44, so that the elongated body has a natural incline angle as illustrated in FIGS. 7 and 8. The incline angle is such that the longitudinal distance between the lower end 42 and the upper end 44 is greater than the internal diameter of the pipe so that the lower end 42 and the upper end 44 have a natural tendency to slide and engage opposite side surfaces of the interior of the well casing as the retrieval tool is being lowered to the bottom 16 of the well 12 as illustrated in FIG. 3. When the retrieval tool 10 descends to a location alongside the pipe and pump assembly 20, the tool is deflected to a more vertical orientation as illustrated in FIG. 4. It should be noted that the lower end 42 easily passes the pipe coupling 28 with the upper end 44 being deflected to orient the elongated body in a somewhat unnatural vertical orientation illustrated in FIG. 4. As the elongated body 40 passes the pipe coupling 42, the upper end has a natural tendency to swing laterally as illustrated in FIG. 5 with the pipe section 22 being received in the notch 52. When this occurs, the retrieval tool is ready to be raised by the retrieval cable 61 until the sides 54 of the notch 52 engage the shoulder joint 30 as illustrated in FIG. 5. At this point, the retrieval tool 10 engages and grips the pipe and pump assembly 20 to carry the pipe and pump assembly upward as the retrieval cable 61 is reeled upward.

In the preferred embodiment, the cable stabilizing means 64 includes a guide or stabilizing ring 66 through which the retrieval cable 61 is threaded. The ring 66 is affixed to the elongated body 40 slightly upward from the center of gravity 41 towards the upper end 44 so that the elongated body has a natural angle of inclination as previously discussed.

Additionally the retrieval tool 10 includes a safety cable connecting means generally designated with the numeral 68 for facilitating the removal of the retrieval tool 10 from the bottom of the well 12 should retrieval tool 10 become stuck. Sometimes, the pump is stuck in quicksand, preventing the retrieval tool from being able to raise the pump and pipe assembly. To disengage and unlock the retrieval tool 10 from the pipe and pump assembly 20, the safety cable connecting means 68 provides a means for a safety cable 69 to be connected to the elongated body 40 adjacent the upper end 44 for orienting the elongated body in a substantially vertical orientation to pull the retrieval tool from the stuck assembly and back to the surface opening 18.

In the preferred embodiment, the safety cable connecting means 68 includes a ring 43 affixed to the nose 48 for enabling the safety cable 69 to pull the elongated body 40 upward to a substantially vertical orientation rather than at the inclined orientation associated with the retrieval cable 61.

It should be noted that the retrieval tool 10 in conjunction with the cable stabilizing means 64 enables retrieval tool 10 to orient itself with respect to the pipe section 22 with the lower end 42 moving downward between the pipe section 22 and the wall casing with the upper end 44 automatically orienting itself to receive the pipe section within the notch or mouth 52. The design of the elongated body 40 naturally orients the retrieval tool 10 with respect to the pipe section 22.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. A pipe and pump retrieval tool for retrieving an unconnected pipe and pump assembly from the bottom of a well with a wall having a known interior diameter, in which the assembly has a pipe section of a known exterior diameter with a pipe coupling on an upper end thereon, in which the pipe coupling has an exterior diameter greater than the diameter of the pipe section forming a joint shoulder at the upper end of the pipe section, comprising:

an elongated body have a length between a lower end and an upper end greater than the interior diameter of the well and a width less than the interior diameter of the well sufficient to enable the body to be lowered to the bottom of the well along side the pipe section and below the pipe coupling, in which the body has a center of gravity between the upper and lower end;

shoulder engaging means at the upper end of the elongated body for engaging the joint shoulder;

cable connecting means for operatively connecting a retrieval cable to the elongated body adjacent the lower end spaced from the center of gravity to raise and lower the elongated body in response to the raising and lowering of the retrieval cable;

body stabilizing means for operatively engaging the retrieval cable and securing the cable to the elongated body at a location spaced from the cable connecting means and between the center of gravity and the upper end for stabilizing the decent of the elongated body to the bottom of the well to an elevation along side the pipe section and for stabilizing the accent of the elongated body to direct the shoulder engaging means into engagement with the pipe section and the joint shoulder to raise the pipe and pump assembly as the elongated body is raised by the retrieval cable.

2. The pipe and pump retrieval tool as defined in claim 1 wherein the shoulder engaging means has a mouth of sufficient size to receive the pipe section therein to partially encircle the pipe section and engage the shoulder to grip the assembly as the retrieval cable is raised.

3. The pipe and pump retrieval tool as defined in claim 1 wherein the body stabilizing means is operatively connected to the elongated body closer to the center of gravity than the upper end.

4. The pipe and pump retrieval tool as defined in claim 1 wherein the body stabilizing means is operatively connected to the elongated body at a distance sufficient to cause the elongated body to have a natural inclined orientation so that the lower and upper ends will normally engage diametrically opposed sections of the well wall during decent above the pipe and pump assembly.

5. The pipe and pump retrieval tool as defined in claim 1 wherein the body stabilizing means includes a ring affixed to the elongated body between the center of gravity and the upper end with the retrieval cable threaded through the ring.

6. The pipe and pump retrieval tool as defined in claim 1 wherein the cable connecting means includes fastening ring affixed to the lower end of the elongated body for receiving a lower end of the retrieval cable.

7. The pipe and pump retrieval tool as defined in claim 1 further comprising sfety cable connecting means for operatively connecting a safety cable to the upper end of the elongated body to pull the elongated body upward with the elongated body substantially vertical.

8. The pipe and pump retrieval tool as defined in claim 1 further comprising safety cable connecting means operatively connecting a safety cable to the upper end of the elongated body to release the shoulder engaging means from the joint shoulder when the safety cable is moved upward relative to the retrieval cable.

9. The pipe and pump retrieval tool as defined in claim 1 wherein the length of the elongated body is at least twice the diameter of the well.

10. The pipe and pump retrieval tool as defined in claim 1 wherein shoulder engaging means is formed as an integral part of the upper end of the elongated body and includes a notch formed in the upper end of sufficient size to receive the pipe section therein.

11. The pipe and pump retrieval tool as defined in claim 10 wherein the notch has beveled surfaces forming sharp edges for engaging the outer surface of the pipe section.

* * * * *